US006612131B2

(12) United States Patent
Cheng

(10) Patent No.: US 6,612,131 B2
(45) Date of Patent: Sep. 2, 2003

(54) EARRING POST AND CONNECTOR ASSEMBLY

(76) Inventor: Howard Cheng, 2821 S. Quinn St., Chicago, IL (US) 60608

( * ) Notice: Subject to any disclaimer, the term of this patent is extended or adjusted under 35 U.S.C. 154(b) by 0 days.

(21) Appl. No.: 09/884,699

(22) Filed: Jun. 19, 2001

(65) Prior Publication Data

US 2002/0189284 A1 Dec. 19, 2002

(51) Int. Cl.[7] ..... A44C 7/00
(52) U.S. Cl. ..... 63/12; 24/705; 24/707.4
(58) Field of Search ..... 63/12; 24/705, 24/707.4

(56) References Cited

U.S. PATENT DOCUMENTS

| | | | | | |
|---|---|---|---|---|---|
| 183,164 | A | | 10/1876 | Hessels | |
| 402,071 | A | | 4/1889 | Doran et al. | |
| 878,885 | A | * | 2/1908 | Knoop | 24/710.9 |
| 1,080,735 | A | | 12/1913 | Tolchin | |
| 1,152,892 | A | * | 9/1915 | Henry | 24/707.4 |
| 1,193,111 | A | * | 8/1916 | Breidenbach | 24/707.4 |
| 2,367,283 | A | * | 1/1945 | Judd | 411/524 |
| 2,653,367 | A | * | 9/1953 | Orchoff | 24/707.4 |
| 2,667,675 | A | * | 2/1954 | Brutti | 24/707.4 |
| 3,040,406 | A | | 6/1962 | Artzt | |
| 3,402,438 | A | | 9/1968 | Battistello | |
| 4,580,417 | A | | 4/1986 | Sardelli | |
| 6,058,581 | A | * | 5/2000 | Ehrlund | 24/705 |
| 6,134,917 | A | * | 10/2000 | Kohl et al. | 24/656 |

* cited by examiner

*Primary Examiner*—Andrea Chop
(74) *Attorney, Agent, or Firm*—Andrus, Sceales, Starke & Sawall

(57) ABSTRACT

A post and connector assembly for an earring of the pierced-ear type utilizes a conventional straight post and a connector that includes a resilient surface that is biased into a groove in the post to establish a positive locking position, but which surface is manually deflectable to release the lock to facilitate both connection and removal of the post.

9 Claims, 4 Drawing Sheets

EARRING POST AND CONNECTOR ASSEMBLY

BACKGROUND OF THE INVENTION

The present invention relates to an assembly of an earring post and a connector for attachment to a pierced ear and, more particularly, to such an assembly in which the connector is positively locked to the post.

Earrings for pierced ears are well known and typically include a post to one end of which a jewel or other jewelry ornament is attached and an opposite free end that is inserted through a hole in an ear lobe of the wearer. A connector is attached over the free end of the post after the post is inserted through the ear lobe to retain the earring.

Two basic types of connectors are typically used with earring posts. In one type, a connector is provided with a threaded bore that is screwed onto a complimentary threaded post. This provides a positive locking of the connector on the post, but is somewhat tedious and time-consuming to use. In another type, which has many variations, the connector is pushed onto the post and held by frictional engagement between the post and a hole or holes in the connector. In certain variations of this type of connector, frictional engagement results from the inherent resilience of the connector, resulting either from a bias force induced by insertion of the post or by manipulation by the user. In either case, the frictional locking force may be inadequate to assure that the connector is secured against inadvertent dislodgment.

Particularly when an earring is made of precious metal and/or includes a precious gem stone or the like, it is important that the connector be positively locked to the post so that inadvertent dislodgment may be prevented.

SUMMARY OF THE INVENTION

The present invention is adapted particularly for use in the assembly of an earring post and connector in which the post is straight and is provided near its free end with an annular groove. The connector includes spaced fixed surfaces that define a pair of aligned holes which are sized to receive the free end of the post. The connector also includes a resilient surface that is manually deflectable to a connecting position where free movement of the post through the pair of aligned holes is permitted. The resilient surface is provided with an edge portion that exerts a radial bias against the post in a locking position when the resilient surface is released from manual deflection. Either the edge portion of the resilient surface or an edge of one of the fixed surfaces engages and is locked in the groove in the post in the locking position.

In the preferred embodiment, the connector is formed from a one-piece sheet metal stamping. In this embodiment, the fixed surfaces are formed from first and second panels that are bent out of the plane of the stamping. Preferably, the panels extend generally perpendicular to the plane of the stampings, and the resilient surface is formed from a third panel that is bent out of the plane of the stamping. The third panel is also provided with an aperture that is aligned with the pair of holes in the first and second panels when the resilient surface is in the connecting position, and the edge portion of the resilient surface is the periphery of the aperture. The periphery of the hole in one of the first and second panels defines a supplemental locking edge such that the post may be selectively secured in either of two locking positions. In another embodiment, the post is provided with a pair of axially spaced annular grooves such that the post may be selectively secured in one of four locking positions.

The connector is also preferably provided with a stop surface to limit axial movement of the post. In another embodiment, the stop surface is formed from a fourth panel that is bent from the plane of the stamping. The connector also preferably includes an alignment abutment that establishes alignment of the pair of holes and the aperture in response to manual deflection of the resilient surface. Realignment abutment may comprise a contact interface between a free edge of one of the panels and a surface of the stamping. Preferably, the abutment comprises an interface between the free edge of the third panel and a surface of the stamping.

In a further embodiment, the connector is made from a tubular-walled member that is sized to receive the post inserted axially therein from one end. The tubular member is provided with a notch in the wall that opens into the interior of the member, the notch defining and axially separating the aligned holes. The resilient surface is formed from a separate sheet metal piece that is attached at one edge to the tubular-walled member and has an opposite free edge received in the notch and in the groove in the post to define the locking position. Preferably, the tubular-walled member includes a closed opposite end that is provided with a smooth outer surface.

DETAILED DESCRIPTION OF THE PREFERRED EMBODIMENTS

Figure 1:
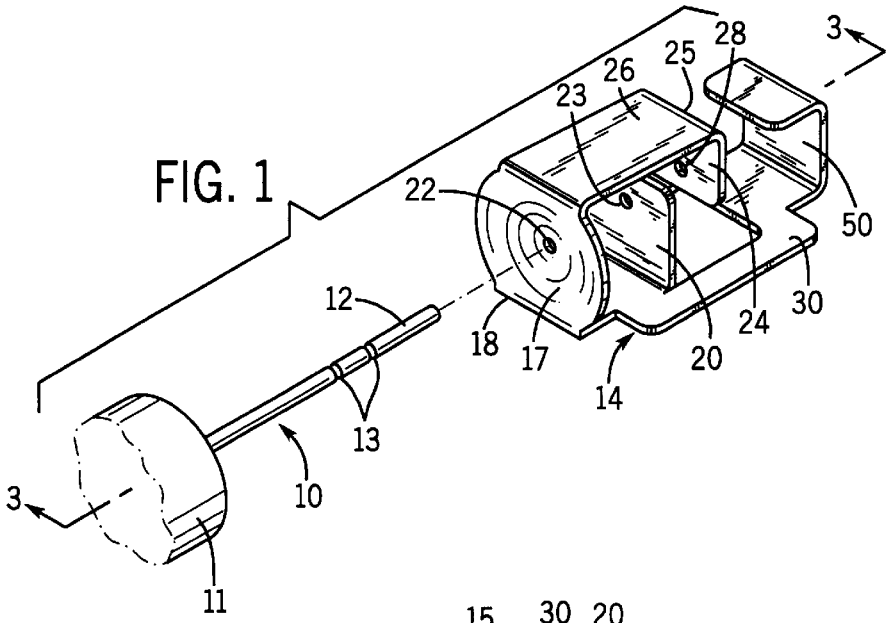
FIG. 1 is an isometric view of the presently preferred embodiment of the invention.

A preferred basic embodiment of the assembly of the present invention is shown in FIG. 1. A straight wire post 10 has a typical earring ornament 11 attached to one end and is provided near its opposite free end 12 with a pair of axially spaced annular grooves 13. The connector 14 is formed from a one-piece metal stamping 15 shown in FIG. 2. The stamping 15 is bent along a number of parallel bend lines 16 (shown as broken lines in FIG. 2) to form a number of generally parallel panels in the connector 14.

Figure 2:
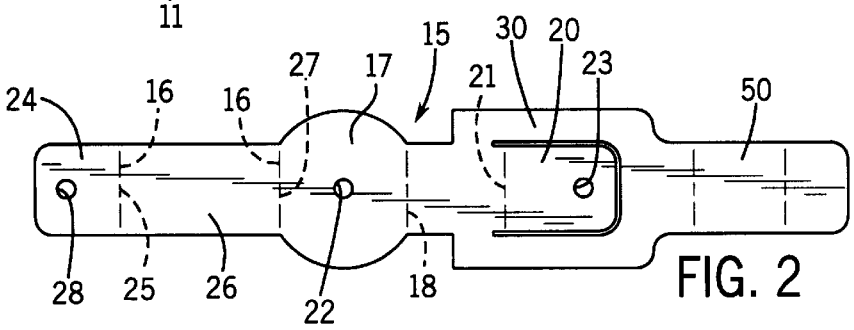
FIG. 2 is a plan view of the sheet metal stamping from which the connector portion of the assembly in FIG. 1 is formed.
Figure 4A:
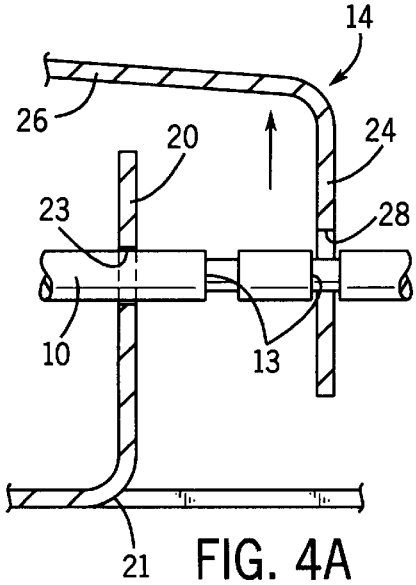
FIGS. 4A and 4B are enlarged sectional views showing respectively the locking position and connecting position of the connector portion of the assembly.
Figure 4B:
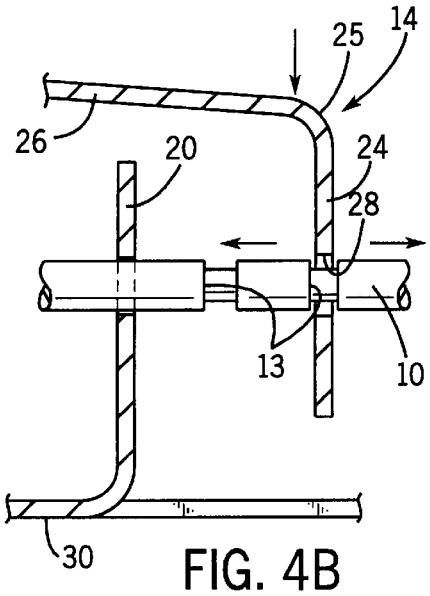

Continuing to refer to FIGS. 1 and 2, a first panel 17 is formed by making a right angle bend in a first bend line 18. A second panel 20 is partially cut or stamped from the interior of the stamping 15 and formed by a right angle bend on a second bend line 21. The first and second panels 17 and 20 are provided with first and second holes 22 and 23, respectively, which holes are axially aligned when the panels 17 and 20 are bent into their operative positions. A third panel 24 is formed by a third bend line 25 at the end of a connecting panel 26 of the stamping 15, which connecting panel is connected at its other end to the first panel 17 along an auxiliary bend line 27. The connecting panel 26 provides a cantilever attachment of the third panel 24 to the first panel 17 and, because of the inherent resilience of the sheet metal from which the stamping 15 is formed (e.g. a gold alloy), the connecting panel 26 and integrally attached third panel 24 may be manually deflected. The third panel 24 is also provided with an aperture 28 which, in the at rest position shown in FIG. 1, is not aligned with the axis defined by the aligned first and second holes 22 and 23 in first and second panels 17 and 20. Rather, aperture 28 is positioned slightly above the axis. Thus, when the post 10 is inserted into the connector 14, it will pass through aligned holes 22 and 23, but the free end 12 of the post will contact the third panel 24 just below the aperture 28. However, if the wearer presses downwardly on the connecting panel 26 (as by grasping the connecting panel and the lower panel 30 of the stamping between the thumb and finger), downward deflection of the third panel 24 will bring the aperture 28 into alignment with the post 10 positioned in the first and second holes 22 and 23. Continued axial movement of the post 10 will cause it to pass through aperture 28, as shown in FIG. 4B. If manual deflection of the connecting panel 26 is then released, the post may continue to be slid along the axis of the aligned holes 22 and 23 and aperture 28 until the first of the grooves 13 reaches the aperture 28. The thickness of the sheet metal stamping 15 is slightly less than the width of the groove 13 in the axial direction and, as a result, the inherent resilience of the metal will cause a slight upward movement of the third panel 24 (as shown in FIG. 4A) to a locking position in which the lower peripheral edge portion of the aperture 28 is captured in the groove. In this locking position, the post is secured against inadvertent dislodgment from the connector. The post may, of course, be unlocked by again pressing the connecting panel 26 to the connecting position (FIG. 4B) and withdrawing the post from the connector.

Figure 8:
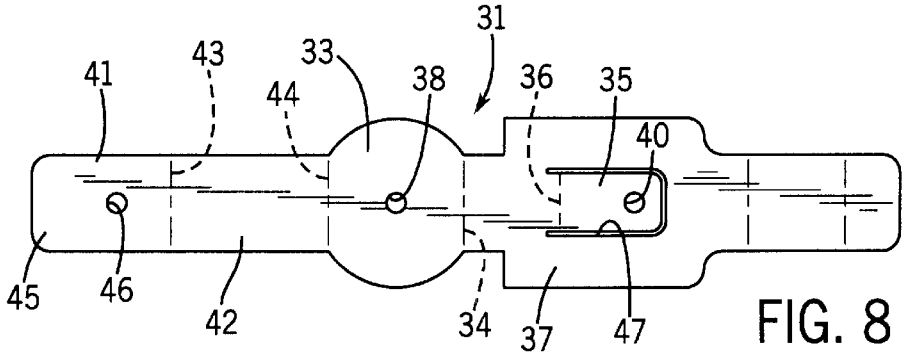
FIG. 8 is a plan view of a sheet metal stamping for an alternate embodiment of the connector.
Figure 9A:
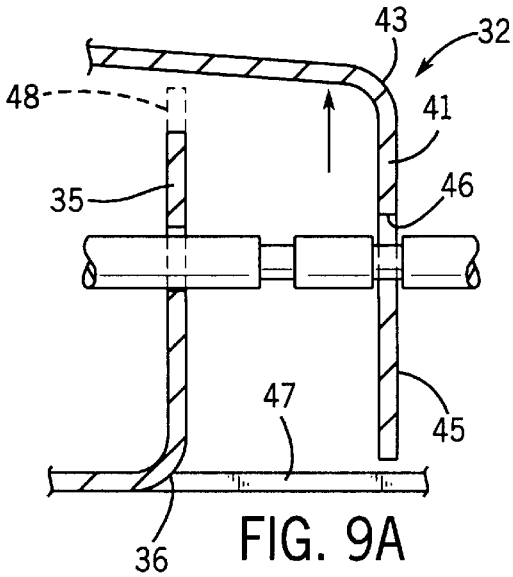
FIGS. 9A and 9B are enlarged partial sectional views showing the respective locking and connecting positions of the connector made from the FIG. 8 stamping.
Figure 9B:
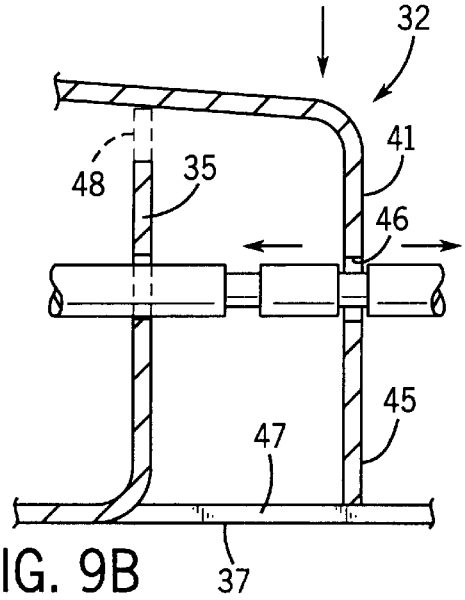

Referring to FIGS. 8, 9A and 9B, it is preferred to provide a means to positively assure alignment of the holes in the three connector panels in the connecting position to facilitate insertion of the post 10. A modified stamping 31 is shown in FIG. 8 and is used to form a connector 32, the operation of which is shown in FIGS. 9A and 9B. The modified stamping 31 is very similar to the stamping 15 of the FIG. 2 embodiment and thus includes similar panels which are bent out of the plane of the stamping along similar bend lines as previously described.

A first panel 33 is formed by bending the stamping along a first bend line 34, and a second panel 35 is partially stamped from a lower panel 37 and formed by bending the panel along a second bend line 36. First and second holes 38 and 40 are axially aligned when the respective first and second panels 33 and 35 are bent into their operative positions. A third panel 41 at one end of the stamping 31 is connected to the first panel by a connecting panel 42. By forming respective right angle bends along a third bend line 43 and an auxiliary bend line 44, the third panel is brought into operative position in the connector in the same manner previously described with respect to the FIG. 1 connector 14.

In this embodiment, however, the third panel 41 has a slightly extended length at the panel end 45. Further, in this particular embodiment, the second panel 35 is slightly narrower in width than the third panel 41. Referring particularly to FIG. 9B, when the connecting panel 42 is depressed to deflect the third panel 41 downwardly and to bring the aperture 46 therein into alignment with the first and second holes 38 and 40, the lower edge of the panel end 45 of the third panel 41 will engage the lower panel 37 by bridging the gap 47 in the lower panel left when the second panel 35 is bent into operative position. In this position of abutment of the panel end 45 against the lower panel 37, the aperture 46 is in direct axial alignment with the first and second holes 38 and 40 to allow free movement of the post 10 therethrough. This positive alignment abutment facilitates both attachment and removal of the post which otherwise is locked in its locking position (FIG. 9A) in the same manner previously described.

An alternate alignment abutment may be provided by extending the length of the second panel 35, as shown in phantom in FIGS. 9A and 9B, instead of extending the length of the third panel 41. The upper end 48 of the second panel 35 is extended such that, upon manual depression of the connecting panel 42 in the direction of the downward pointing arrow in FIG. 9B, the underside of the connecting panel contacts the extended upper end 48 of the second panel 35 to establish alignment of the aperture 46 with the first and second holes 38 and 40. When the manual deflection of connecting panel and the third panel 41 is released, the panels will resiliently return to their at rest position as soon as the post 10 is moved axially to bring a groove 13 into alignment with the aperture 46, where upon the panels 41 and 42 will move upwardly in the direction of the arrow in FIG. 9A causing the panel 41 to exert a radial bias against the post and to secure the same in the locking position.

Referring also to FIGS. 3A–3D, two additional features of the present invention are shown. One feature is the wide range of locking positions which may be attained using a post 10 with two grooves 13 and utilizing engagement between the second panel 20, as well as the third panel 24, as a locking surface. The other feature is the use of a fourth panel 50 formed at the opposite end of the stamping 15 to provide an axial stop surface for the free end 12 of the post and to protect the body surface of the wearer from sharp contact by the post end. This feature will be described in greater detail below.

Figure 3A:
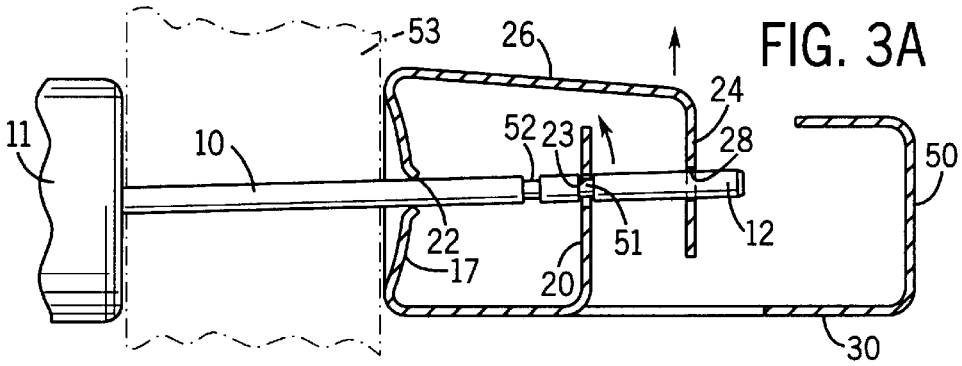
FIGS. 3A–3D are sectional views of the FIG. 1 connector showing each of the four selective locking positions.
Figure 3B:
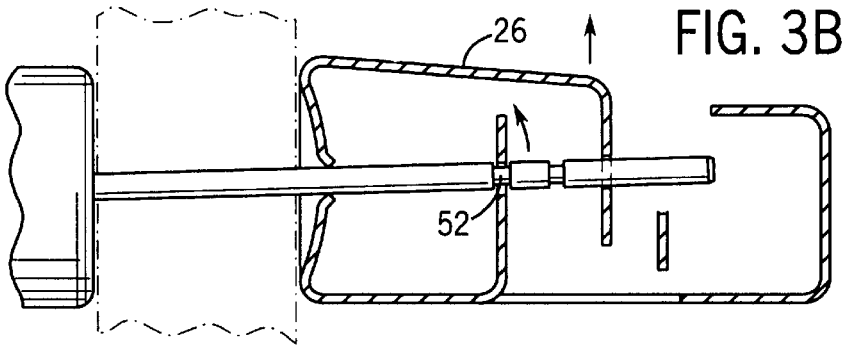
Figure 3C:
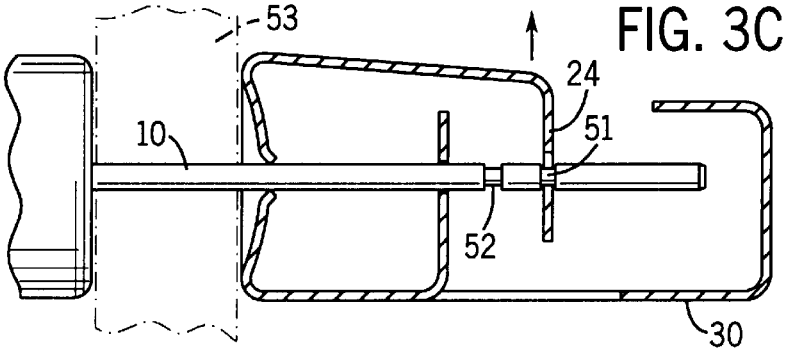

Referring again to FIGS. 3A–3D, there are shown four locking positions of the post 10 in the connector 14. In FIG. 3A, the endmost or first groove 51 is locked against the periphery of the hole 23 in the second panel 20 as a result of the resilient radial bias imposed on the post end by the third panel 24, as shown by the upwardly extending arrow. This position accommodates a relatively thick ear lobe 53 (or other body part). In FIG. 3B, a snug fit on a somewhat thinner ear lobe 53 is attained by utilizing the second groove 52 in the post locked in the second panel 20. For respectively thinner ear lobes (or other body parts), as shown in FIGS. 3C and 3D, the third and second grooves 51 and 52 may alternately be locked in the aperture 28 in the third panel 24, as previously described with respect to the FIG. 1 embodiment.

Figure 3D:
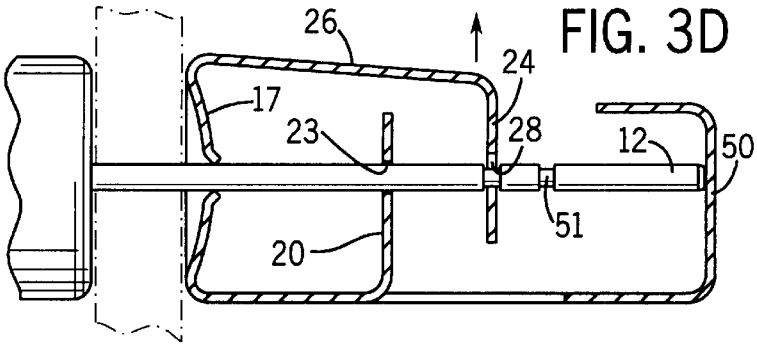

In the locking position shown in FIG. 3D, the free end 12 of the post 10 engages the fourth panel 50. The panel 50 protects the surface of the wearer's body which would otherwise be contacted by the free end of the post. It also provides a positive stop against further axial movement of the post.

Figure 5:
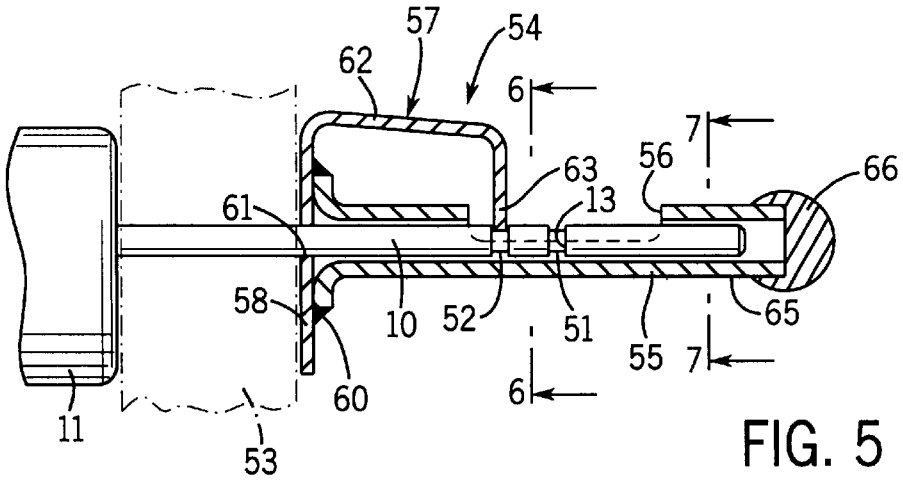
FIG. 5 is a sectional side view of an alternate embodiment of the connector.
Figure 6:
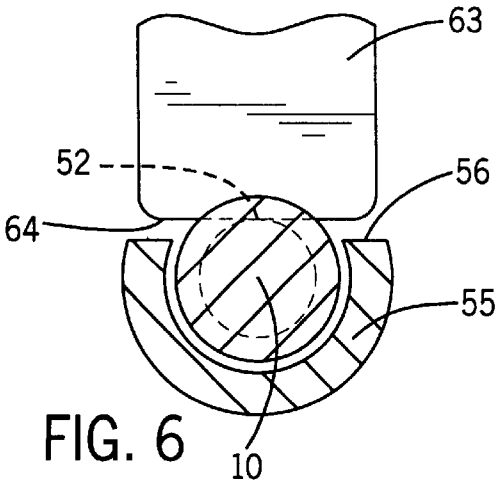
FIG. 6 is a sectional view taken on line 6—6 of FIG. 5.
Figure 7:
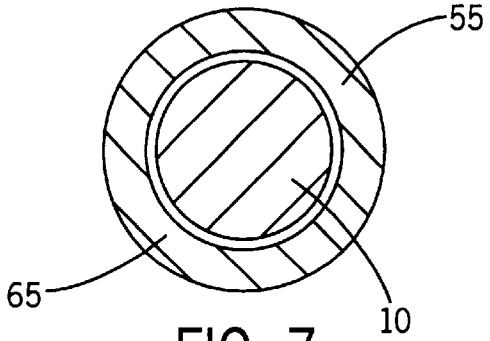
FIG. 7 is a sectional view taken on line 7—7 of FIG. 5.

An alternate embodiment of the invention is shown in FIGS. 5–7. The post 10 is the same as in the previously described embodiments and the connector 54 functions in a similar manner. However, the construction of the connector 54 is substantially different. The connector includes a hollow tubular member 55 which has an upper central portion cut out to define a notch 56. A U-shaped panel member 57, bent from a sheet metal stamping, has a first panel 58 which is secured to one end of the tubular member 55 as with a soldered connection 60. The first panel 58 is provided with a hole 61 that is aligned with the open end of the tubular member 55 so the post 10 can be inserted therein. A connecting panel 62 joins the first panel 58 to a locking panel 63 in a similar manner as the cantilever connection of the third panel 24 via the connecting panel 26 in the FIG. 1 embodiment. The locking panel 63 is positioned to be resiliently biased against the post 10 and, when one of the grooves 51 or 52 on the post becomes positioned under the free edge 64 of the locking panel 63, the panel edge will enter the groove and lock the post in position. In either locking position, the free end 12 of the post is received in the tubular end portion 65 as shown in FIGS. 5 and 7. To unlock the post, as for removal or position adjustment, the user squeezes the tube and the opposite lateral edges of the connecting panel 62 between a thumb and finger, providing a wedging action that lifts the connecting panel and causes the free edge 64 of the locking panel to move out of the groove. While the panel is held manually in this position, the post 10 may be easily slid out of the tubular member 55. The tubular end portion 65 of the tubular member is provided with a closure 66. The closure 66 is a small smooth ball of a compatible metal, such as a gold alloy and is intended to protect the body surface of the wearer against contact by the relatively sharper tubular end portion 65 or the free end 12 of the post.

I claim:

1. An caning post and connector assembly comprising:

a generally straight post of circular cross section having an ornamental end and a free opposite end provided with an annular groove;

a unitary connector formed from an initially flat sheet metal piece bent to form first, second and third spaced surfaces, the first and second surfaces including one of a pair of aligned circular holes sized slightly larger than the post to receive the free end of the post and to hold the post on the axis of said pair of aligned circular holes;

the second surface partially cut from an interior portion of the piece;

the third surface having a third circular hole sized to receive the post, said third surface being manually deflectable from a position in which said third hole is non-aligned with said axis to a connecting position against an abutment surface in which said third hold is in direct axial alignment with said post and said pair of aligned holes to permit the post to be inserted through said third hole, and said third surface operative to return to a locking position exerting a radial bias against the post and capturing an edge of one of said second and third surfaces in said groove upon release from said connecting position.

2. The assembly as set forth in claim 1 including a fourth surface bent from the plane of the sheet metal piece, said forth surface providing a stop surface to limit axial movement of the post.

3. The assembly as set forth in claim 1 including an alignment abutment establishing alignment in response to manual deflection of said third surface.

4. The assembly as set forth in claim 3, wherein said abutment comprises a contact interface between a free edge of one of said surfaces and a of said sheet metal piece.

5. The assembly as set forth in claim 3, wherein said abutment comprises a contact interface between a free edge of said third surface and a surface of said sheet metal piece.

6. The assembly as set forth in claim 1, wherein one of said first and second surfaces and said third surface has a thickness less than the axial width of the groove in the post and the periphery of the hole therein defines an edge portion adapted to be received in said groove in the locking position.

7. The assembly as set forth in claim 6, wherein said one surface and the third surface have edge portions selectively receivable in said groove to provide two alternate locking positions.

8. The assembly as set forth in claim 7, wherein said post has a pair of axially spaced grooves in either of which said edge portions are selectively receivable to, provide four alternate locking positions.

9. An earring post and connector assembly comprising:

a generally straight post having an ornamental end and a free opposite end provided with an annular groove;

a unitary connector formed from an initially flat sheet metal piece bent to form first, second and third spaced surfaces, the first and second surfaces including one of a pair of aligned holes sized to receive the free end of the post;

the second surface partially cut from an interior portion of the piece;

the third surface having a third hole sized to receive the post, said third surface being manually deflectable to a connecting position to bring said third hole into axial alignment with said pair of aligned holes to permit the post to be inserted through all said holes, and said third surface operative to return to a locking position exerting a radial bias against the post and capturing an edge of one of said second and third surfaces in said groove upon release from said connection position; and, a fourth surface bent from the plane of the sheet metal piece, said fourth surface providing a stop surface to limit axial movement of the post.

* * * * *